US005686688A

United States Patent [19]

Kazyaka et al.

[11] Patent Number: 5,686,688

[45] Date of Patent: Nov. 11, 1997

[54] NOISE ABATEMENT SYSTEM FOR LARGE CALIBER GUN

[75] Inventors: Raymond P. Kazyaka; Raymond J. Kazyaka, both of Scotia, N.Y.

[73] Assignee: Wright Malta Corporation, Ballston Spa, N.Y.

[21] Appl. No.: 741,927

[22] Filed: Oct. 31, 1996

Related U.S. Application Data

[63] Continuation of Ser. No. 603,442, Feb. 20, 1996, abandoned.

[51] Int. Cl.[6] ..... F41A 2/00

[52] U.S. Cl. ..... 89/14.4; 89/36.01; 73/167

[58] Field of Search ..... 89/36.01, 36.04, 89/14.4; 181/223; 73/167

[56] References Cited

U.S. PATENT DOCUMENTS

| | | | |
|---|---|---|---|
| 883,077 | 3/1908 | Baker | 273/410 |
| 941,642 | 11/1909 | Maxim | 273/410 |
| 3,217,534 | 11/1965 | Bingham et al. | 273/410 |
| 3,720,411 | 3/1973 | DeVogelaere | 273/102 R |
| 4,445,693 | 5/1984 | Angwin | 273/404 |
| 4,728,109 | 3/1988 | Simonetti | 273/410 |
| 4,787,289 | 11/1988 | Duer | 89/36.02 |
| 4,919,437 | 4/1990 | Salabe et al. | 273/410 |
| 5,121,671 | 6/1992 | Coburn | 89/36.02 |
| 5,171,020 | 12/1992 | Wojcinski | 273/410 |
| 5,357,796 | 10/1994 | Jamison | 73/167 |
| 5,398,589 | 3/1995 | Kazyaka et al. | 89/14.4 |
| 5,435,571 | 7/1995 | Wojcinski et al. | 273/410 |
| 5,461,962 | 10/1995 | Krumm et al. | 89/14.4 |
| 5,477,733 | 12/1995 | Duarte | 73/167 |

OTHER PUBLICATIONS

"Navy Can Silence a Howitzer If It Really Wants to Be Neighborly," *Washington Herald*, p. A3, Saturday, Oct. 19, 1957.

*Primary Examiner*—J. Woodrow Eldred

*Attorney, Agent, or Firm*—Ratner & Prestia

[57] ABSTRACT

A noise abatement system for a large caliber gun includes a gun muffler and a projectile stop, both of which are mounted on a concrete slab. The gun muffler can be coupled at an end to a gun tube of the gun and serves to attenuate pressure waves caused by the firing of a projectile by the gun. The projectile stop is longitudinally aligned with the gun muffler and serves to selectively stop projectiles fired by the gun and to selectively permit projectiles to pass. The projectile stop preferably has an opened first end closest to the gun muffler and a second end to which a door is mounted. When it is desired to aim for a target beyond the projectile stop, the doors are opened to permit the projectile to pass through the projectile stop unhindered. When the projectile stop is used to stop projectiles, the doors are closed and the projectile stop is filled with a particulate material, such as sand.

13 Claims, 18 Drawing Sheets

NOISE ABATEMENT SYSTEM FOR LARGE CALIBER GUN

This application is a continuation of application Ser. No. 08/603,442 filed Feb. 20, 1996 now abandoned.

FIELD OF THE INVENTION

The present invention relates to a system for minimizing the noise generated by the firing of a large caliber gun and, when desired, for stopping a projectile fired by the gun.

BACKGROUND OF THE INVENTION

Due to the increased population in the world, the noise generated by the testing of large caliber weapon systems in communities located near testing facilities of such weapon systems is becoming an increasing problem. As a result of this concern, there has been a need for a gun muffler or system for attenuating the generated noise level. Preferably, such a system should be able to rapidly and safely attenuate the noise generated by the firing of a projectile by a large caliber gun.

When a firing range has limited space, it is desirable to cause the projectile fired by a gun to be stopped a short distance from the firing of the gun. Accordingly, a system for attenuating the generated noise level should also preferably be capable of stopping a projectile fired by the gun.

SUMMARY OF THE INVENTION

The present invention is directed to a noise abatement system for a large caliber gun having a gun tube. The system includes a horizontal concrete slab; a gun muffler, mounted on the concrete slab and having an end adapted to be coupled to the gun tube, for attenuating pressure waves caused by a firing of a projectile by the gun; and a projectile stop, mounted on the concrete slab and longitudinally aligned with the gun muffler, for selectively stopping the projectile fired by the gun and for selectively permitting the projectile to pass.

Preferably, the projectile stop has an opened first end closest to the gun muffler and a second end to which a door is mounted. The door is closed to stop the projectile fired by the gun and is opened to permit the projectile to pass through the projectile stop unhindered. The projectile stop may be comprised of steel and may be substantially rectangular. When it is desired to aim for a target beyond the projectile stop, the doors are opened to permit the projectile to pass through the projectile stop unhindered. When the projectile stop is used to stop projectiles, the doors are closed and the projectile stop is filled with a particulate material, such as sand.

BRIEF DESCRIPTION OF THE DRAWINGS

The invention is best understood from the following detailed description when read in connection with the accompanying drawings, in which.

DETAILED DESCRIPTION OF THE INVENTION

Figure 14:
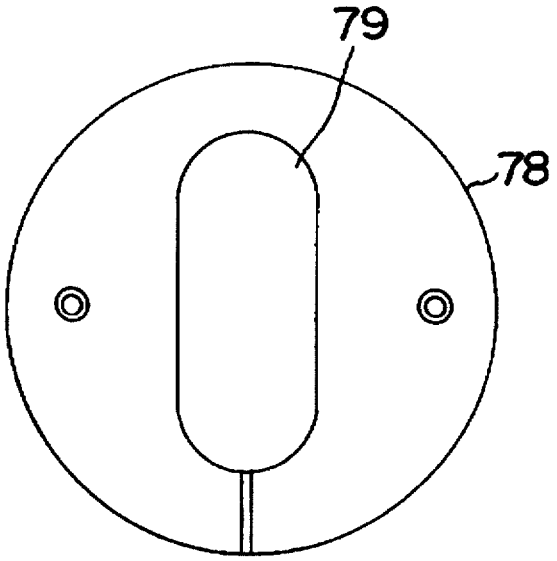
FIG. 14 is a plan view of an orifice plate having an elliptical orifice.
Figure 15:
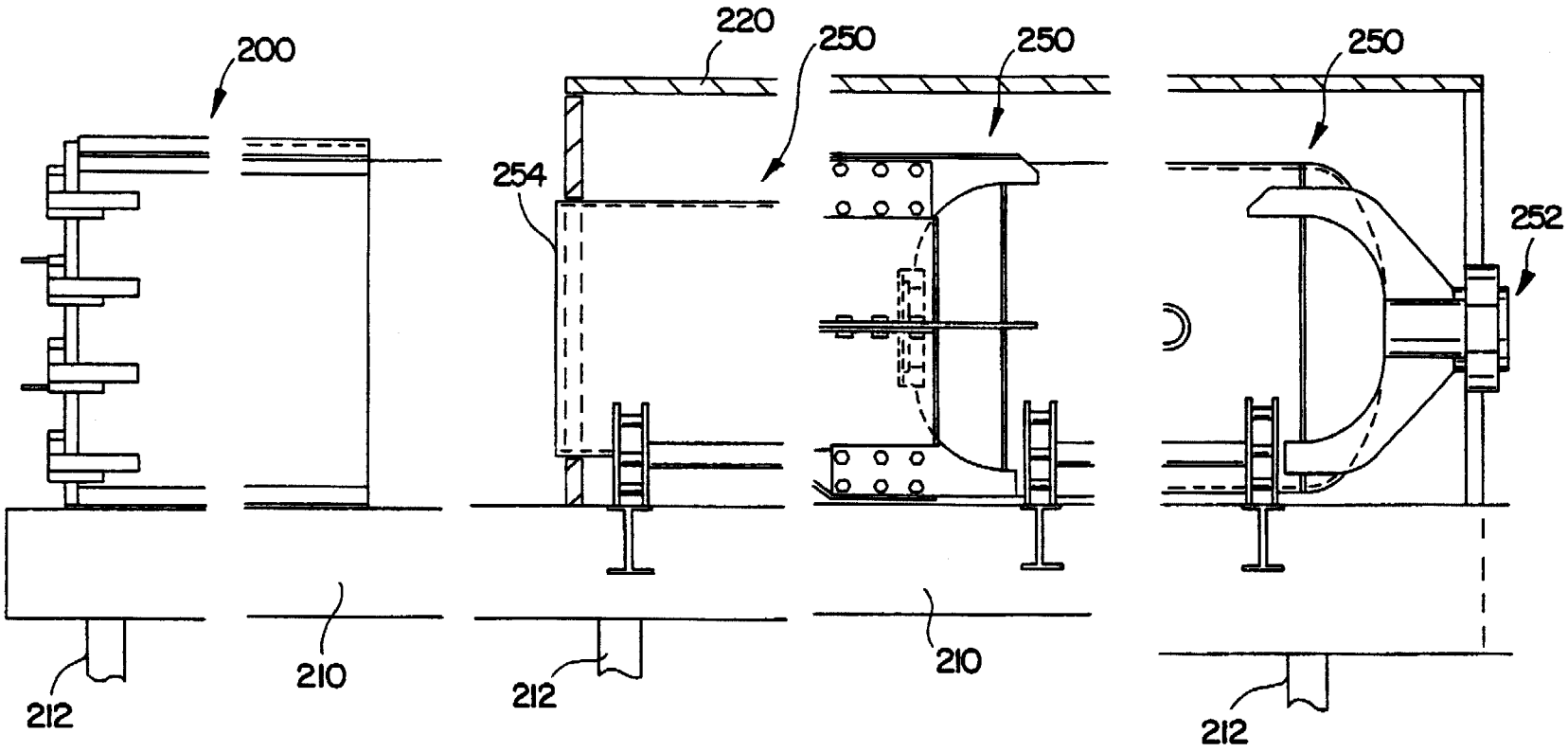
FIG. 15 is a longitudinal side elevational view of the noise abatement system of the present invention.

Referring to FIG. 15, the noise abatement system of the present invention generally includes a gun muffler 250, a projectile stop 200, and a concrete slab 210. Gun muffler 250 can be selected from gun muffler 50 discussed below in connection with FIGS. 1–9 or gun muffler 150 discussed below in connection with FIGS. 10–14. Alternatively, gun muffler 250 can include some features from both gun muffler 50 and gun muffler 150. As discussed in detail below, gun muffler 250 serves to attenuate pressure waves caused by a firing of a projectile of a gun. Gun muffler 250 has a first end 252 which is adapted to be coupled to the tube of a gun, as discussed in more detail below. Gun muffler 250 is mounted to concrete slab 210 in any known manner. For example, gun muffler 250 may be mounted to concrete slab 210 by using bolts in a similar manner as discussed below in connection with the mounting of projectile stop 200 with concrete slab 210.

Concrete slab 210 may be prepared from any conventional poured concrete. Concrete slab 210 should have a thickness sufficient to support gun muffler 250 and projectile stop 200, including when the projectile stop is loaded with a particulate material such as sand. Preferably, concrete slab 210 may have a thickness of 2 to 6 feet, and more preferably 4 feet. As shown in FIG. 15, concrete slab 210 has a greater thickness near end 252 of gun muffler 250 than the remainder of concrete slab 210. Not shown in FIG. 15 is the gradual decrease in thickness of concrete slab 210 occurring between the first and second shown portions of gun muffler 250 near end 252. As shown in FIG. 15, concrete slab is preferably horizontal. Preferably, concrete slab 210 is anchored to the ground or earth. For example, a plurality of support piles 212 may extend downward from concrete slab 210 to bedrock.

Figure 16:
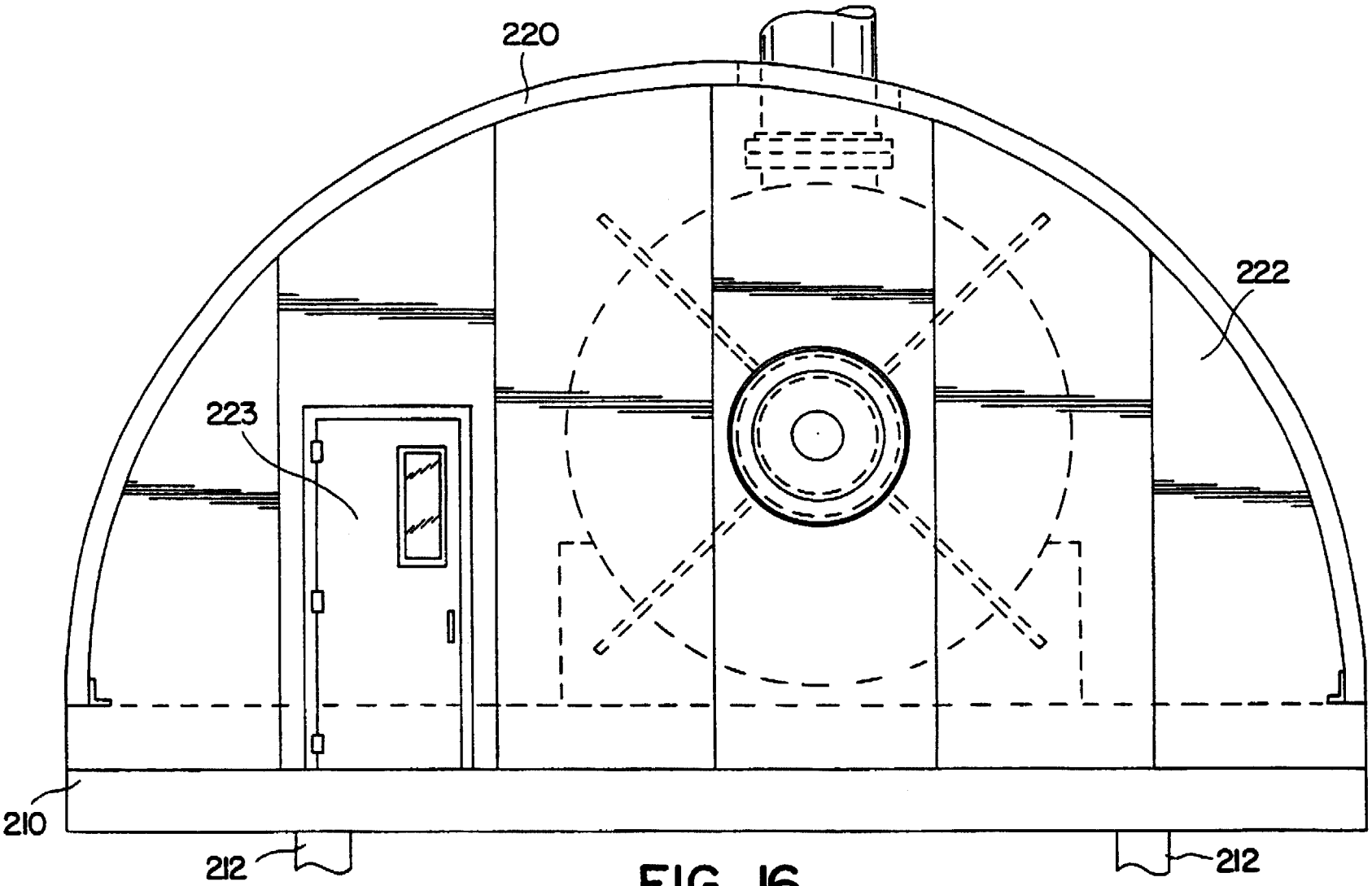
FIG. 16 is an enlarged transverse end view, showing an end of the enclosure of a gun muffler used with the present invention, taken along the line 16—16 of FIG. 15.
Figure 17:
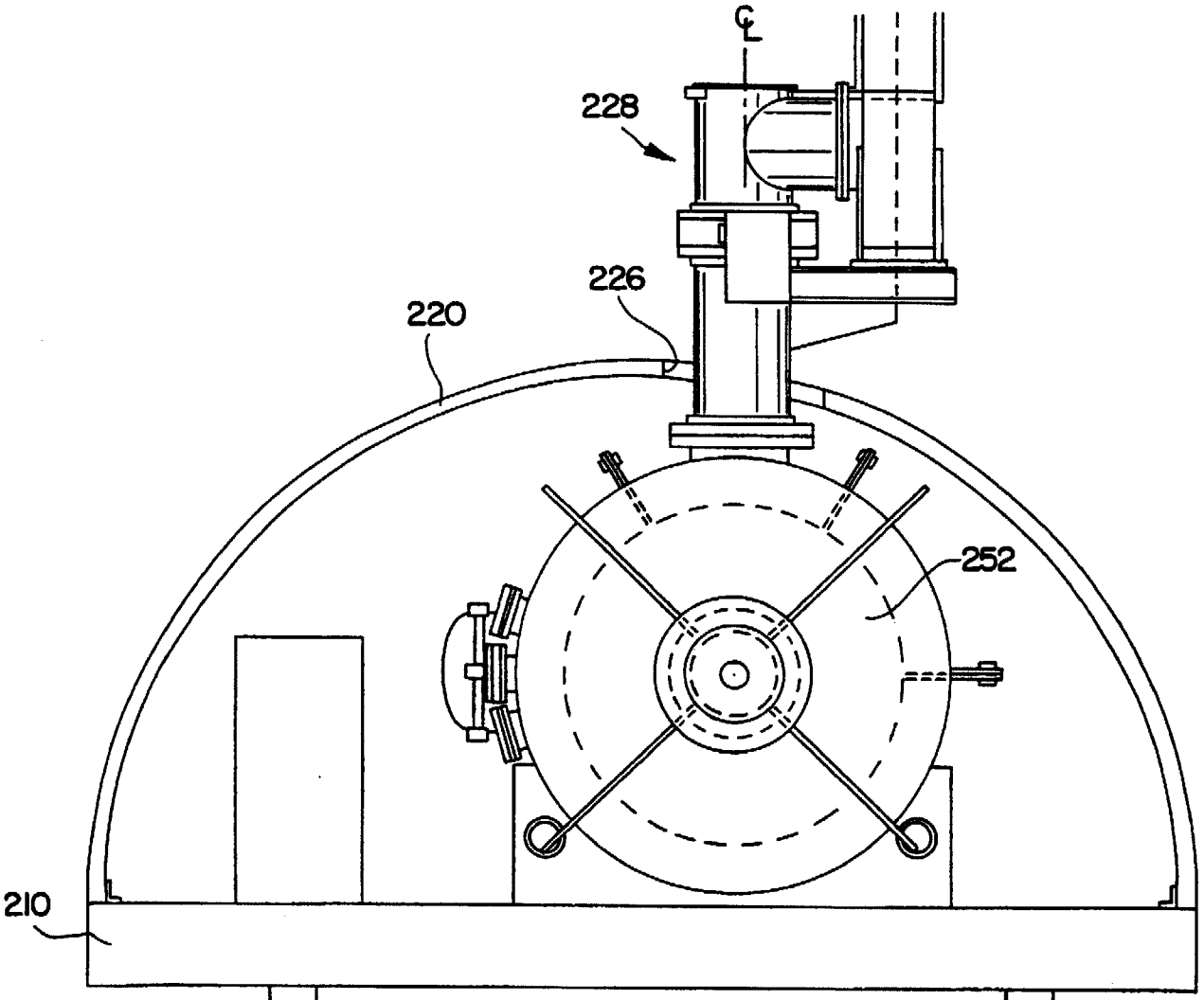
FIG. 17 is an enlarged transverse view (with the end wall removed), showing an end of a gun muffler used with the present invention, token along the line 17—17 of FIG. 15.
Figure 18:
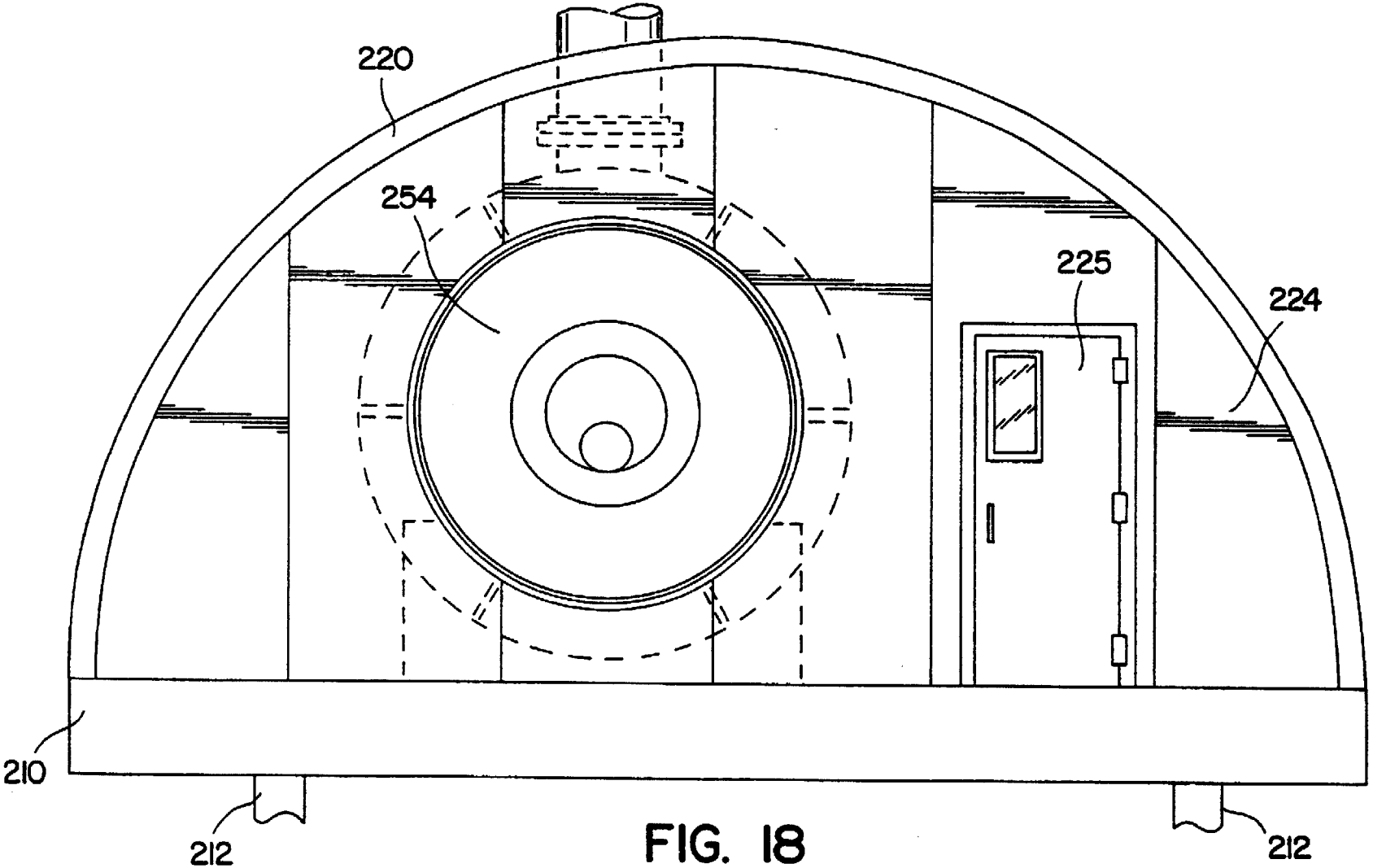
FIG. 18 is an enlarged transverse end view, showing the other end of the enclosure of a gun muffler used with the present invention, taken along the line 18—18 of FIG. 15.

Shown in FIG. 15 and more clearly in FIGS. 16–18 is a housing or arch (e.g., a "Quonset" arch) which serves to protect the gun muffler and the related instrumentation, such as the valves, hatches, and electrical instrumentation, from the environment. Arch 220 may be any suitable material, such as light weight corrugated steel, sheet metal, or plastic. As shown in FIGS. 16 and 18, arch 220 is disposed over gun muffler 250 and has end walls 222 and 224 at each end with, respectively, doors 223 and 225 for personnel to enter the interior of the arch, as shown in FIG. 17. FIG. 17 also shows end 252 of gun muffler 250. An opening 226 exists in arch 220 for permitting valve and blower assembly 228 to extend through and to the exterior of arch 220.

Figure 20:
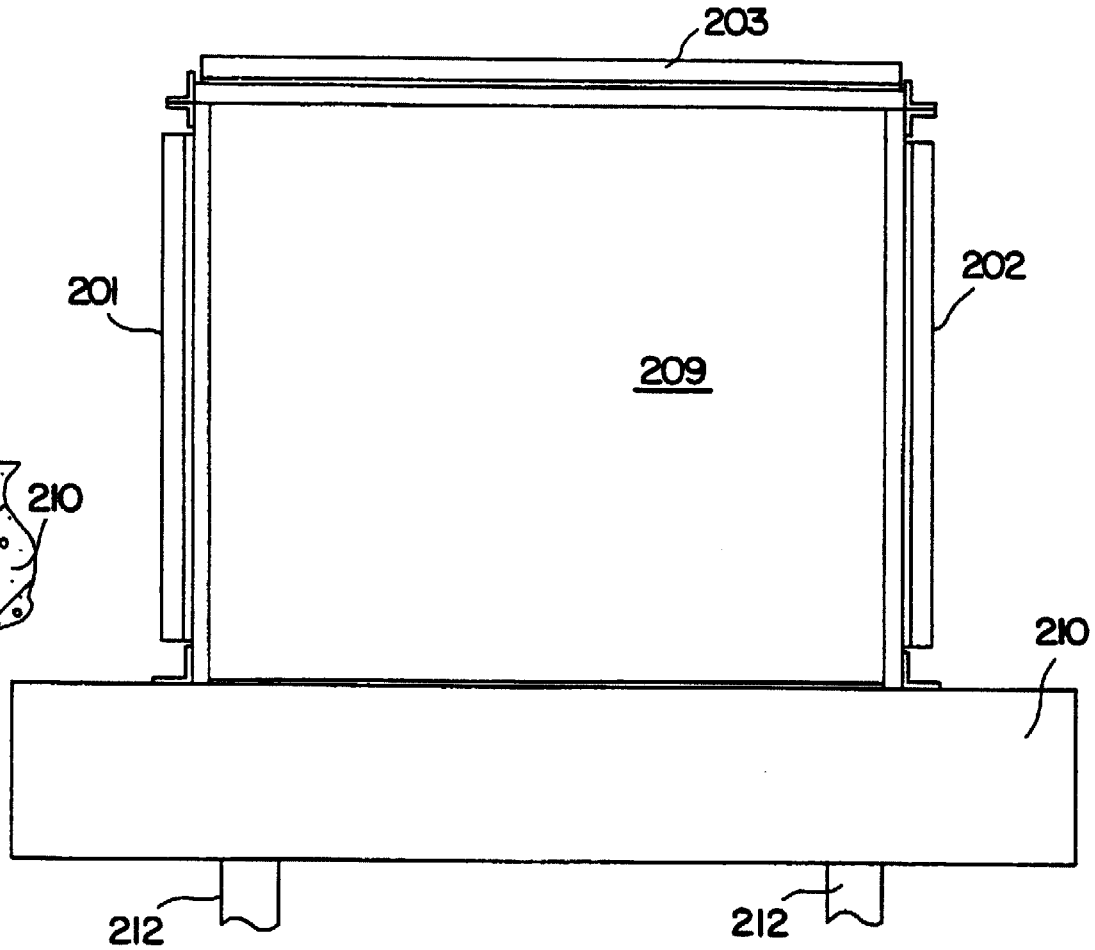
FIG. 20 is an enlarged transverse end view, showing the end of the projectile stop closest to the gun muffler used with the present invention, taken along the line 20—20 of FIG. 15.
Figure 19:
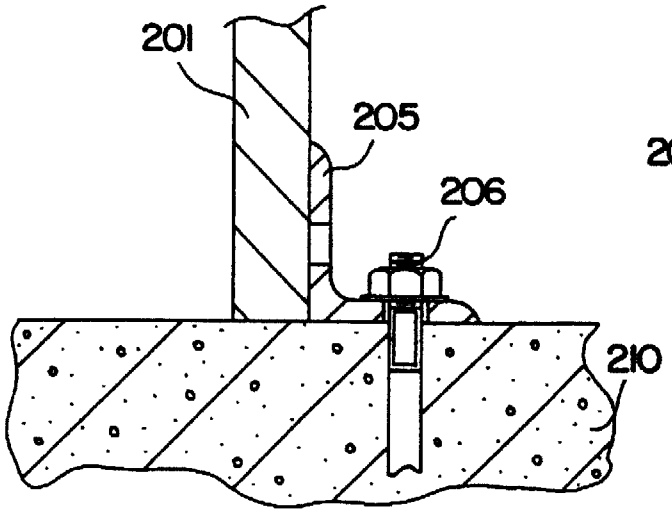
FIG. 19 is an enlarged transverse sectional view, showing the connection between the projectile stop and the concrete slab, taken along the line 19—19 of FIG. 22.

FIGS. 20–23 show the ends, sides, and top of projectile stop 200. As shown, projectile stop 200 is substantially rectangular in shape. Each side, wall, and top of projectile stop 200 can be made of steel, preferably about 4 inches thick. As shown in FIG. 20, projectile stop 200 is comprised of first side wall 201, second side wall 202 (identical to first side wall 201), and top plate 203. In use, side walls 201, 202 may be 10 feet high, and top plate 203 may be 12 feet wide. FIG. 19 shows how projectile stop 200 is mounted to concrete slab 210. More specifically, an "L-connector" 205 is mounted to the base of side walls 201 and 202 and then is subsequently affixed to concrete slab 210 by bolt 206. L connector may be connected to side wall 201 by a similar bolt (not shown).

Figure 21:
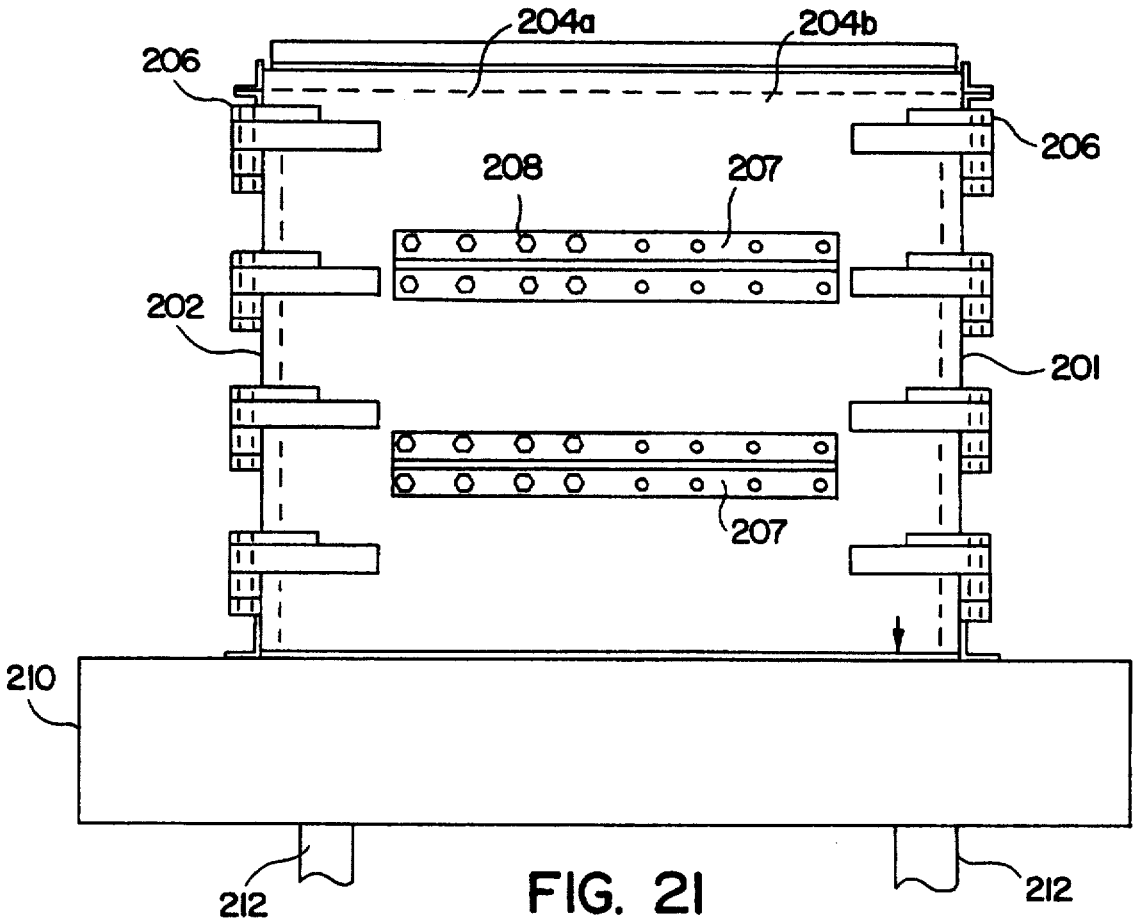
FIG. 21 is an enlarged transverse end view, showing the other end of the projectile stop, taken along the line 21—21 of FIG. 15.

FIG. 21 shows doors **204*a* and 204*b* which are respectively mounted by conventional heavy duty hinges 206 to side walls 202 and 201, respectively. Accordingly, doors 204*a* and 204*b* can swing open and closed as needed. To lock the doors a closed position, latches 207 are aligned with recesses in the doors (not shown) and bolts are subsequently screwed through recesses 208 in the latches and into the recesses of the doors 204*a* and 204*b*** to keep the doors closed.

Figure 22:
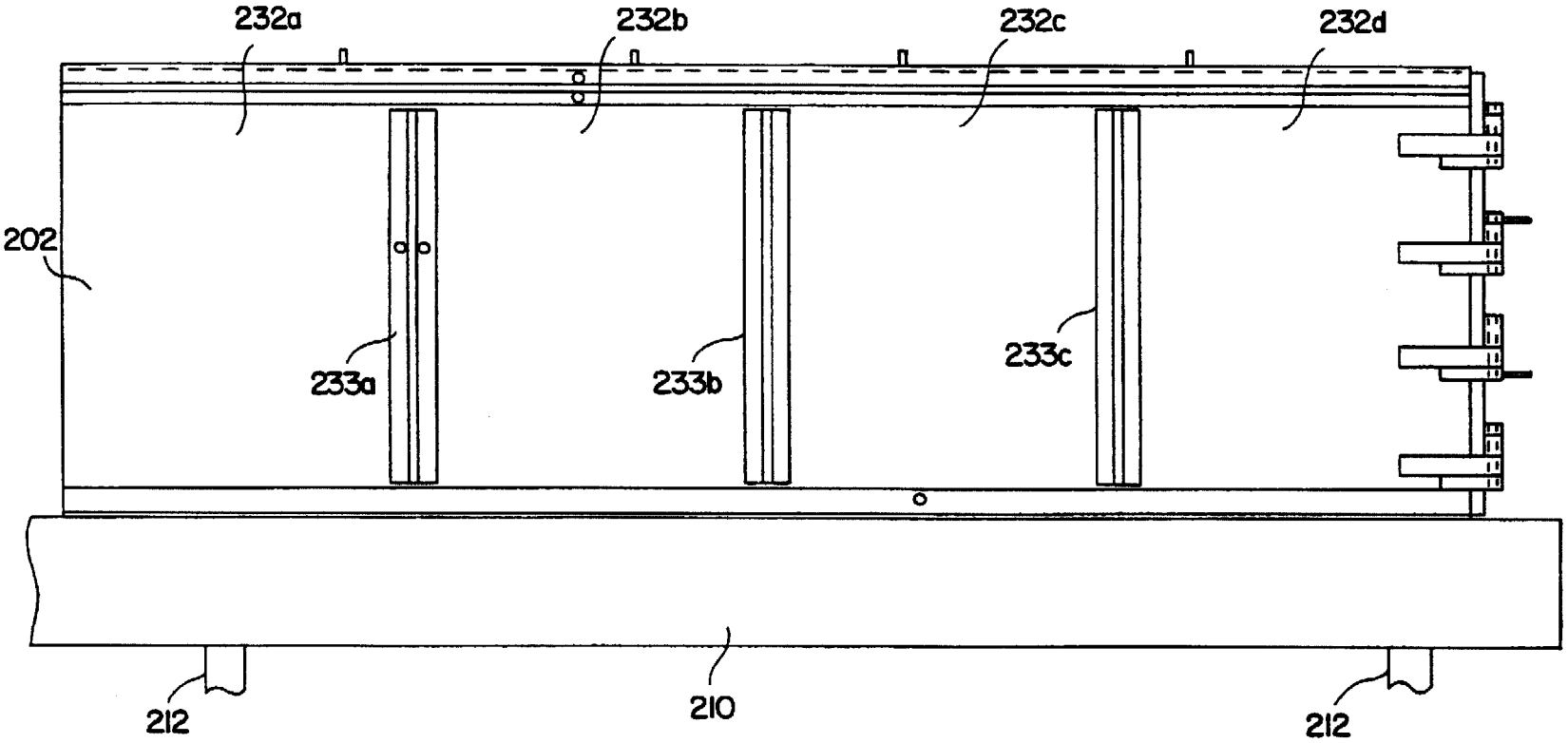
FIG. 22 is a side elevational view of the projectile stop shown in FIG. 15.

FIG. 22 shows side wall 202 mounted on concrete slab 210. As shown, side wall 202 can actually be comprised of a plurality of panels **232*a*, 232*b*, 232*c*, and 232*d*. Panels 232*a–d* can be connected to one another by connectors 233*a–c***.

Figure 23:
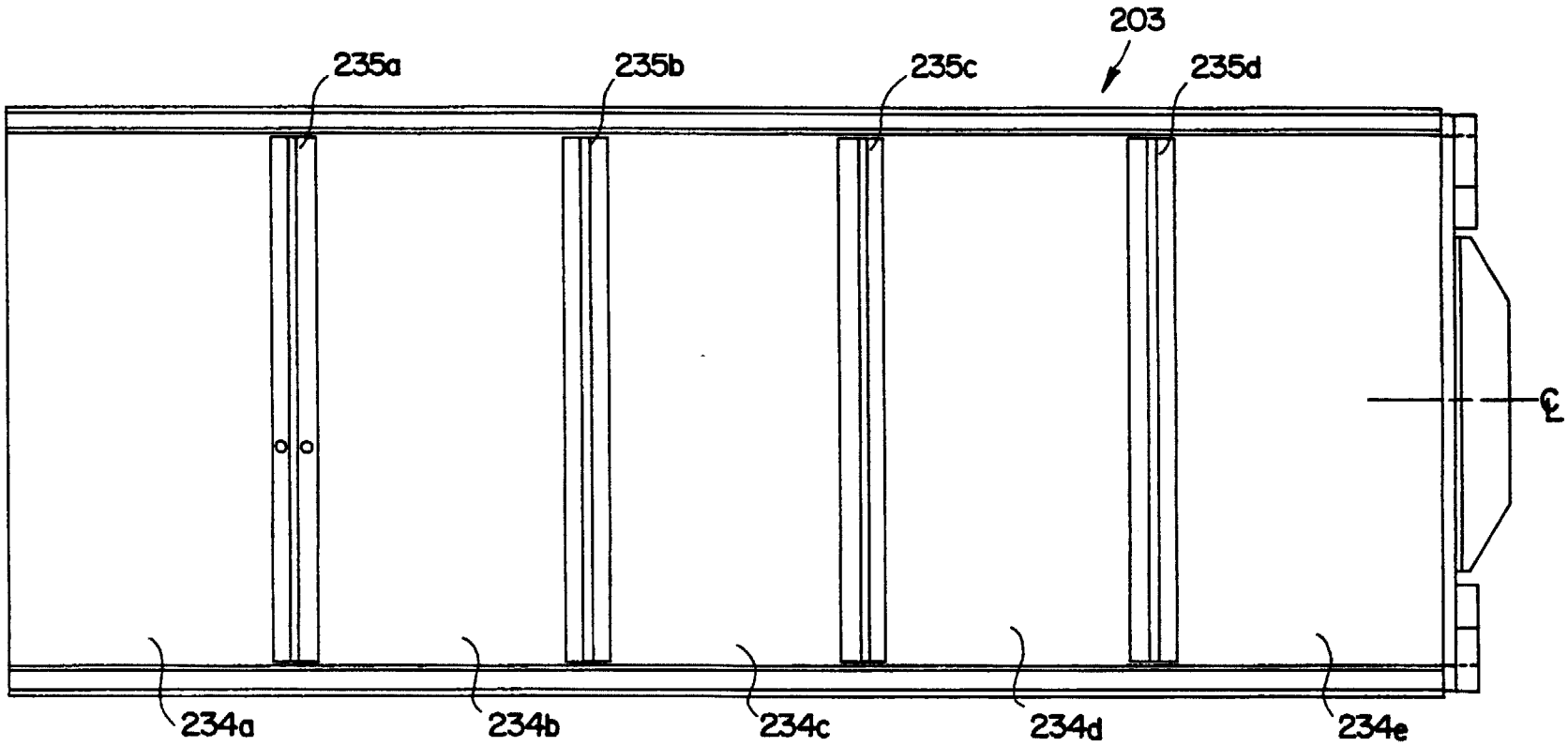
FIG. 23 is a top plan view of the projectile stop shown in FIG. 15.

FIG. 23 shows top plate 203. In the same manner as side walls 201 or 202, top plate can actually be comprised of a plurality of top panels **234*a–e*, which can be connected by connectors 235*a–d*. Top plate 203 is coupled to side walls 201 and 202** in any known manner, such as by being bolted thereto, and may be removable by a crane, for repairs.

As shown in FIG. 15, projectile stop 200 is longitudinally spaced from gun muffler 250. In operation, when it is desired to aim at a target beyond the projectile stop 200, doors **204*a*, *b* are opened and interior space 209 is emptied by a front end loader through the open end of projectile stop 200. When it is desired to stop the projectile, doors 204*a*, *b* are shut and locked into place by use of latches 207. Subsequently, interior space 209 is filled with a particulate material, such as sand, through the open end of the projectile stop 200. Then the gun is fired and the projectile subsequently retrieved upon emptying of interior space 209**.

It is desirable to build the projectile stop of a sufficient size such that over 1 million foot-pounds of energy can be absorbed. In one embodiment, which is 10 feet high, 12 feet deep, and 32 feet long, such a projectile stop can absorb over 40 million foot-pounds of energy when filled with sand. Thus, such a system can be used to stop 6.1 inch diameter projectiles.

The present invention uses a muffler for a large caliber gun having a gun tube. As used herein, a "large caliber gun" refers to a gun having the size of at least 155 mm. Although a muffler used with the present invention could be made for smaller guns, for example, as low as 30 mm, it is normally not needed to muffle the noise generated from such smaller guns. With a gun muffler used with the present invention, the noise level is attenuated by 30% at 100 yards from the firing of the gun and by 95% at 300 yards from firing of the gun.

Figure 1:
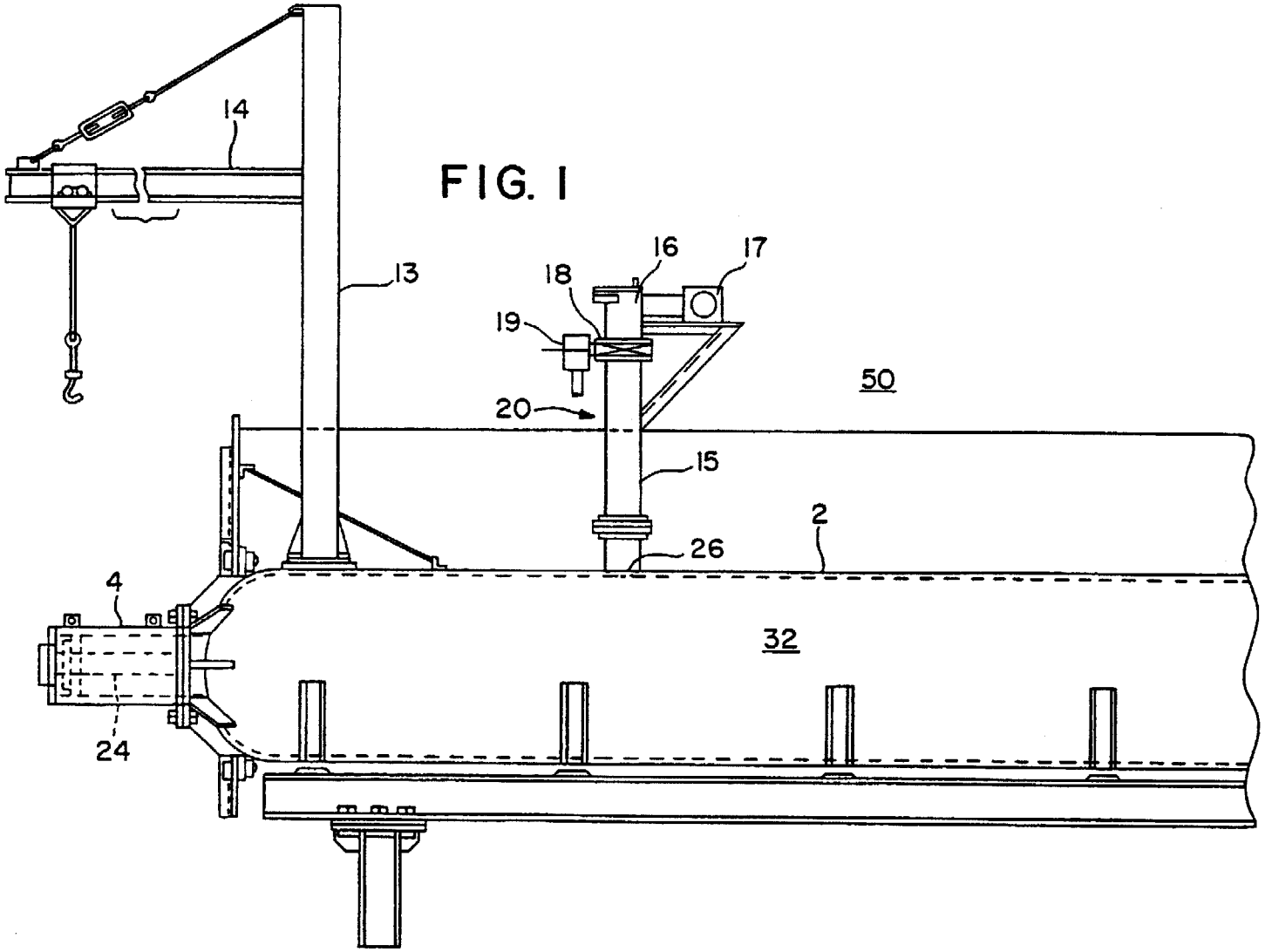
FIG. 1 is a fragmentary longitudinal side elevational view of the left portion of a first embodiment of a gun muffler used with the present invention.
Figure 1A:
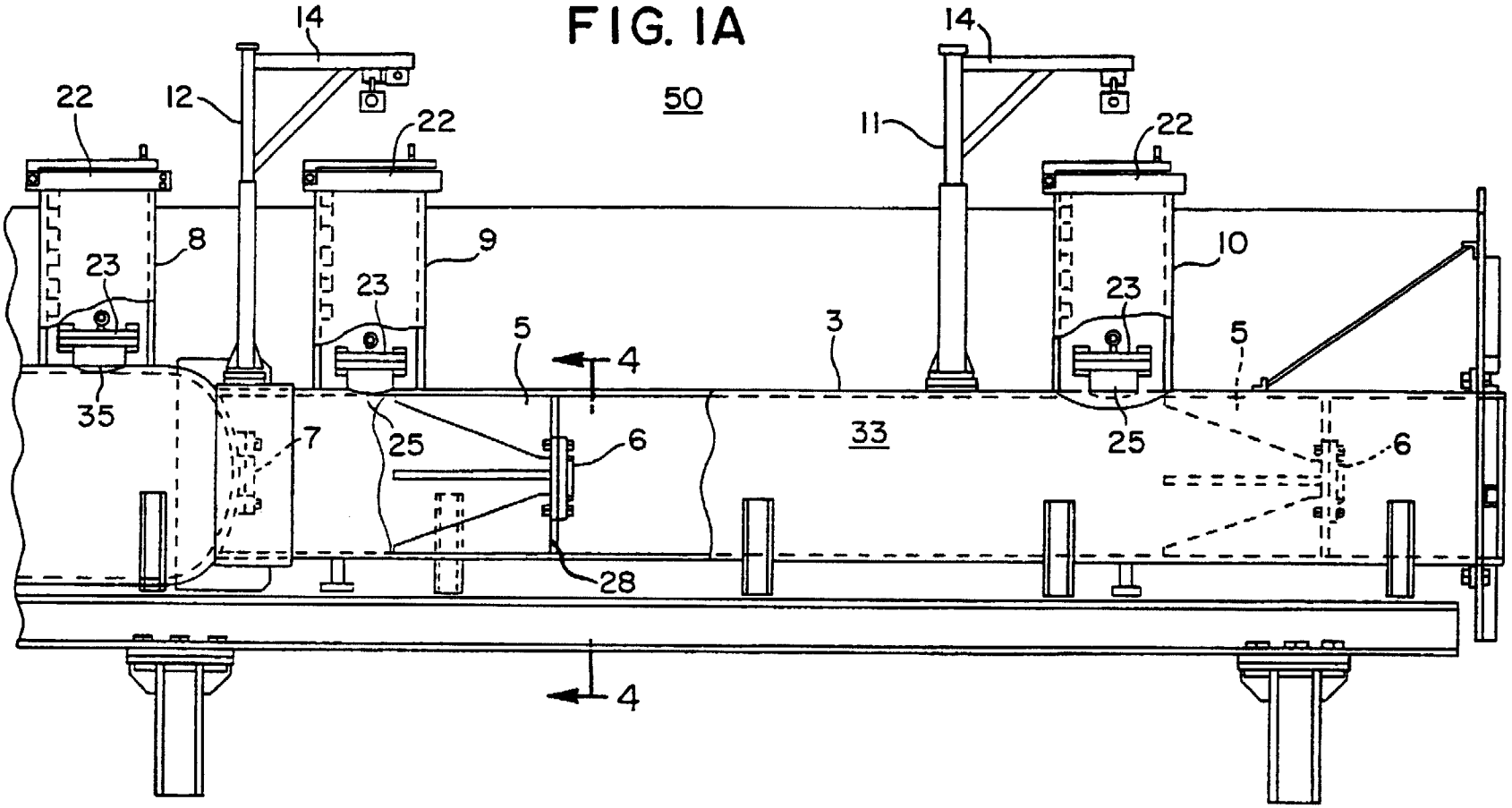
FIG. 1A is a fragmentary longitudinal side elevational view of the right portion of the gun muffler shown in FIG. 1.

Referring to FIGS. 1 and 1A, a gun muffler 50 in accordance with a first embodiment of the present invention is shown. The gun muffler includes a transition section 4 which fits around the gun tube 24 and engages the gun tube for preventing the escape of residual combustion gases caused by a firing of the gun. At least one pressure vessel is attached to transition section 4. As shown in FIGS. 1 and 1A, the pressure vessels include a main pressure vessel 2 defining a main pressure chamber 32 and an extension pressure vessel 3 defining an extension pressure chamber 33. Extension pressure vessel 3 is disposed in series with and connected to main pressure vessel 2. The two pressure vessels may be bolted together.

As shown, main pressure vessel 2 and extension pressure vessel 3 are generally cylindrical. In one embodiment, the main pressure vessel is about 4,000 cubic feet (9 feet in diameter and 64 feet long) and the extension pressure chamber is approximately 1,000 cubic feet.

Main pressure vessel 2 includes a port 26. A vent stack 20 is coupled to main pressure vessel 2 at port 26 and includes a lower vent stack 15 and an upper vent stack 16. Lower vent stack 15 is in permanent fluid communication with main pressure chamber 32 by way of port 26. Disposed in upper vent stack 16 is an exhaust blower 17. Exhaust blower 17 should be capable of rapidly creating a vacuum in main pressure chamber 32 and extension pressure chamber 33 for venting residual combustion gases from these chambers to the atmosphere by way of port 26. Blower 17 may be a squirrel-cage blower having drum type blowers or vanes.

Disposed in vent stack 20 is a valve 18, which separates upper vent stack 16 from lower vent stack 15. Accordingly, valve 18 is disposed between main pressure chamber 32 and exhaust blower 17. Valve 18 is actuated by actuator 19, which is air-operated. Valve 18 should be capable of withstanding high pressure, for example, pressure above 600 psi.

According to an embodiment of the invention, valve 18 is a commercially available butterfly valve having a twenty-four inch diameter through port and is capable of operating at 1,000 psig. Also, actuator 19 can be a pneumatic actuator which operates at 100 psig and is controlled by an electrically operated solenoid valve. Valve 18 is operated to be closed during firings of the gun and opened between firings of the gun.

At the end of main pressure vessel 2 which is coupled to extension pressure vessel 3 is an orifice plate 7. Orifice plate 7 is an annular disk defining a central circular hole through which the projectile passes. The size of the hole is dictated by the size of the projectile. Also, if the hole is too small, it is difficult to rapidly vent extension pressure chamber 33 through the hole and out through port 26 by way of exhaust blower 17. On the other hand, if the hole of orifice plate 7 is too large, the muffling of sound is not sufficient. It has been found that for a projectile of 155 mm, the orifice plate 7 should have a hole of about ten inches in diameter.

Figure 4:
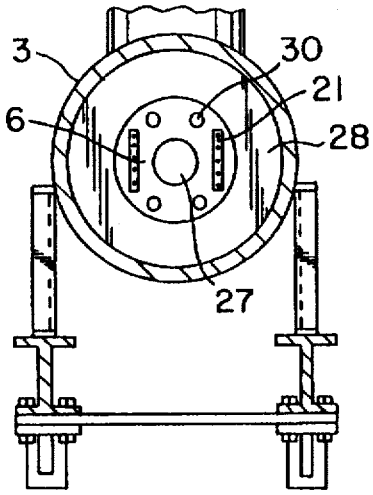
FIG. 4 is a fragmentary transverse vertical sectional view, showing the orifice plate, taken along the line 4—4 of FIG. 1A.

As shown in FIG. 1A, two baffle and orifice assemblies are disposed in series in extension pressure chamber 33. These energy-absorbing baffle and orifice assemblies each comprise a baffle 5 and an orifice plate 6. Baffles 5 are generally conical in shape, having a diameter which linearly decreases from the entry end of extension pressure chamber 3 to the exit end of extension pressure chamber 3. Baffle 5 abuts against orifice plate 6, which is also shown in FIG. 4. A retaining wall 28 is coupled to extension pressure chamber 3, and orifice plate 6 is mounted to retaining wall 28 by way of straps 21 and nuts and bolts 30. Similar to orifice plate 7, orifice plate 6 defines a central hole 27 through which a projectile passes. The diameter of hole 27 is defined by similar functional requirements as the diameter of the hole of orifice plate 7.

Also shown in FIG. 1A are vent/access stacks 8, 9, 10. Vent/access stacks 8, 9, 10 include stack covers 22, which could be mounted by way of a hinge to the vent/access stacks. Each vent/access stack covers an access cover 23 which is mounted over an access port 25, 35. Access ports 25 are in communication with extension pressure chamber 33, and access port 35 is in communication with main pressure chamber 32. The purpose of these access stack assemblies is to permit personnel to enter into main pressure chamber 32 or extension pressure chamber 33 for maintenance or repair.

Because of the size and weight of the parts of vent/access stacks 8, 9, 10 cranes 11, 12, each having crane arms 14, are used to remove and replace stack covers 22 and access covers 23. Furthermore, crane 13, having crane arm 14, is used to remove and mount transition section 4.

Figure 2:
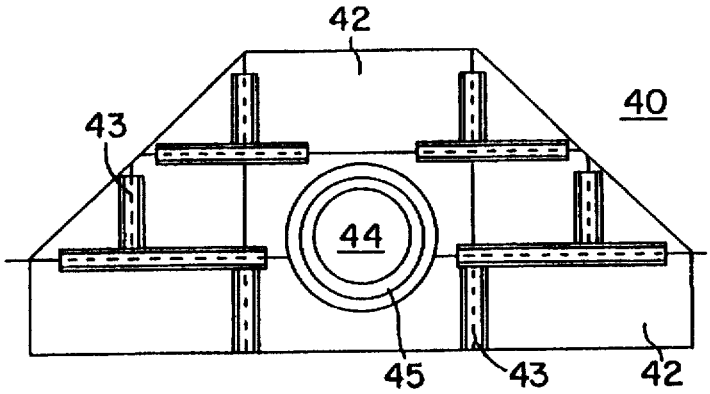
FIG. 2 is an elevational view of the reinforced left-end plate of the gun muffler.
Figure 3:
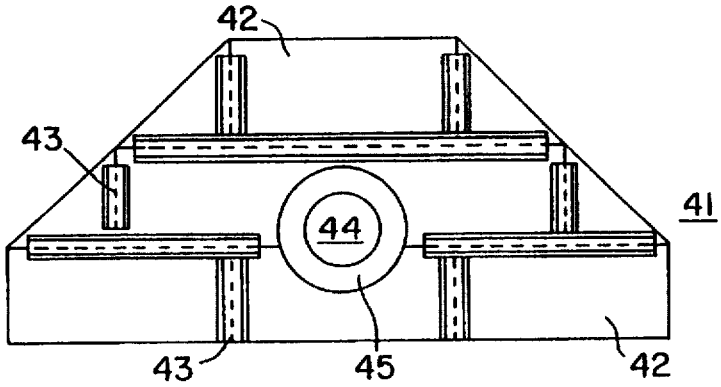
FIG. 3 is an elevational view of the reinforced right-end plate of the gun muffler.

FIGS. 2 and 3 show respectively the left-end plate 40 and right-end plate 41 of the present invention. Each end plate includes individual plates 42 which are connected to one another by connector beams 43. Each end plate defines a central hole 44. Preferably, each end plate includes removable annular disks 45 so that the diameter of central hole 44 can be changed to accommodate various sizes of guns.

Left-end plate 40 is placed vertically at the entry end of transition section 4. A gun tube is pushed through central hole 44 and into transition section 4. Preferably, the innermost removable annular disk 45 sealingly engages the gun tube.

Right-end plate 41 is placed on the exit end of extension pressure chamber 3. A supplemental tube is placed through central hole 44. Preferably, the innermost annular disk 45 sealingly engages the supplemental tube.

The purpose of left-end plate 40 and right-end plate 41 is to retain sand so that the main pressure vessel 2 and extension pressure vessel 3 can be entirely covered in sand during operation. By covering the muffler SO in sand, the muffling effect is increased, although the muffler need not be covered in sand.

Figure 5:
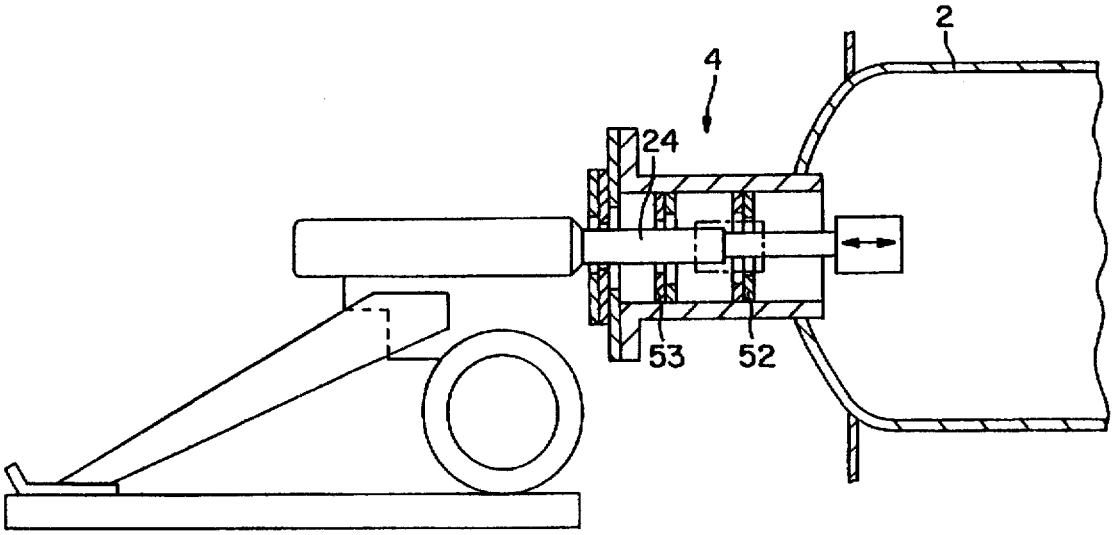
FIG. 5 is a fragmentary side elevational view of a gun and gun muffler, partly in section.
Figure 6:
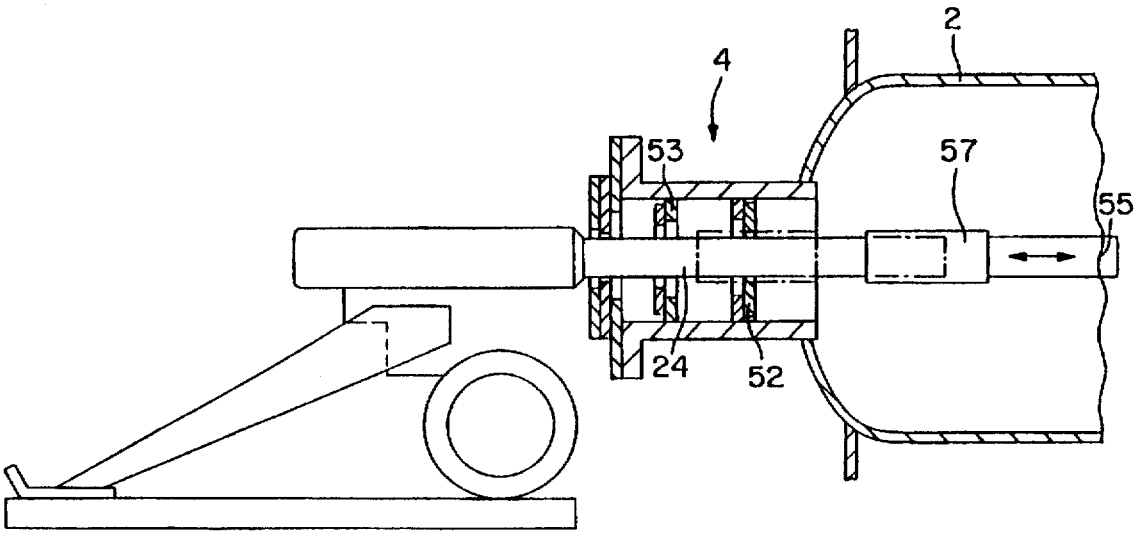
FIG. 6 is a fragmentary side elevational view of a gun, having a longer tube than the gun shown in FIG. 5 and the gun muffler, partly in section.

FIGS. 5 and 6 show transition section 4 in detailed cross section. FIG. 5 shows a gun having a shorter gun tube than the gun tube of FIG. 6. In either case, transition section 4 includes radially inward protruding flanges 52, 53 which serve as seals for engaging gun tube 24 for preventing residual combustion gases caused by the firing of the gun from escaping back through transition section 4. FIG. 6 also shows a supplemental tube 55 having an enlarged portion 57 which fits over gun tube 24. The projectile passes through gun tube 24 and through supplemental tube 55 through the entire muffler 50.

Figure 7:
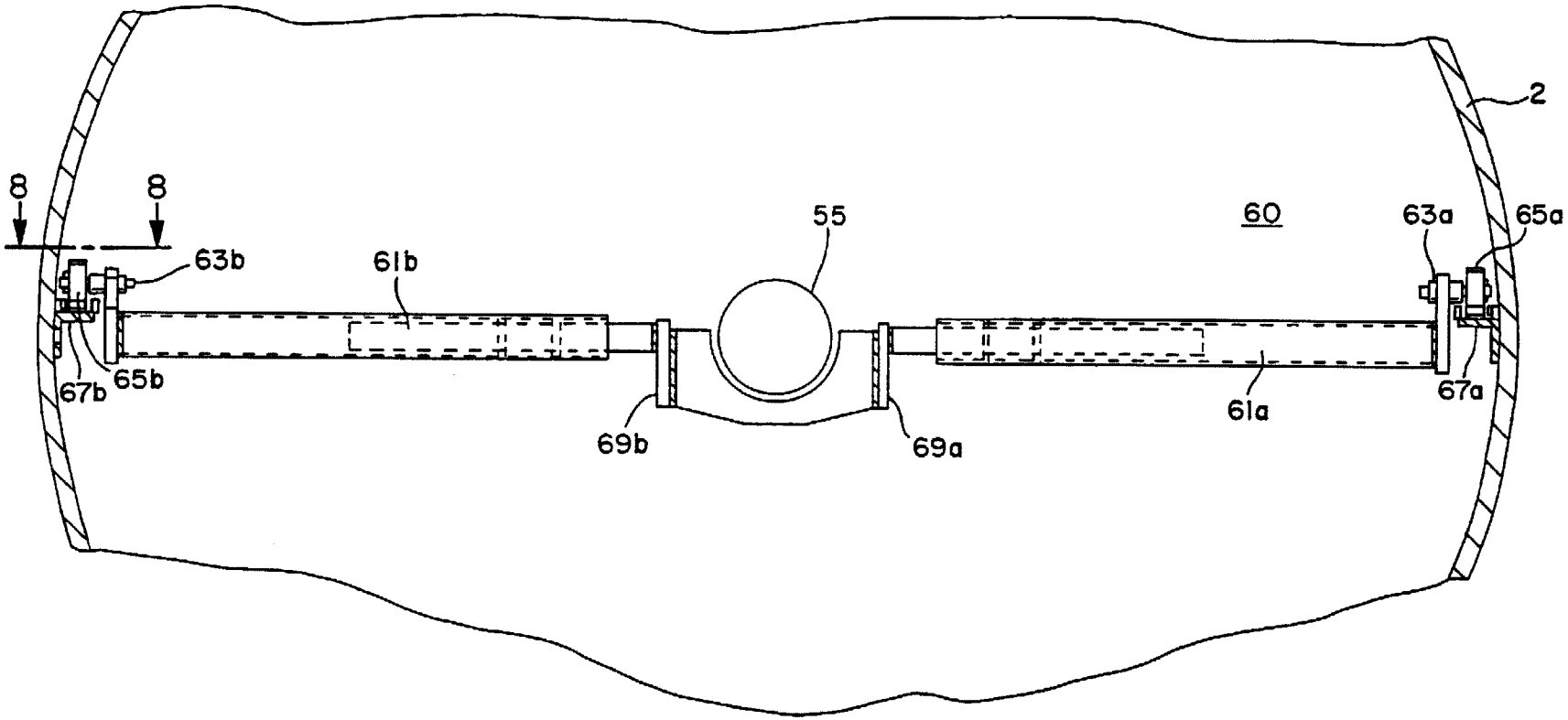
FIG. 7 is an enlarged fragmentary transverse sectional view, showing a tube transporter used with the present invention.
Figure 8:
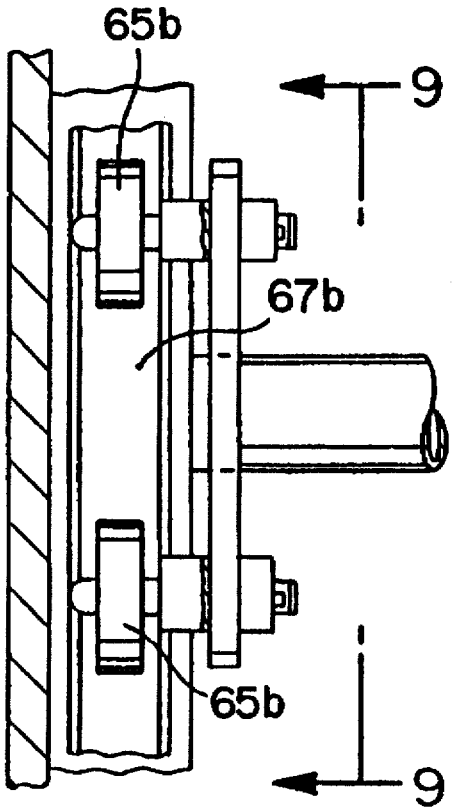
FIG. 8 is an enlarged fragmentary horizontal sectional view of a portion of the tube transporter of FIG. 7, taken along the line 8—8 of FIG. 7.
Figure 9:
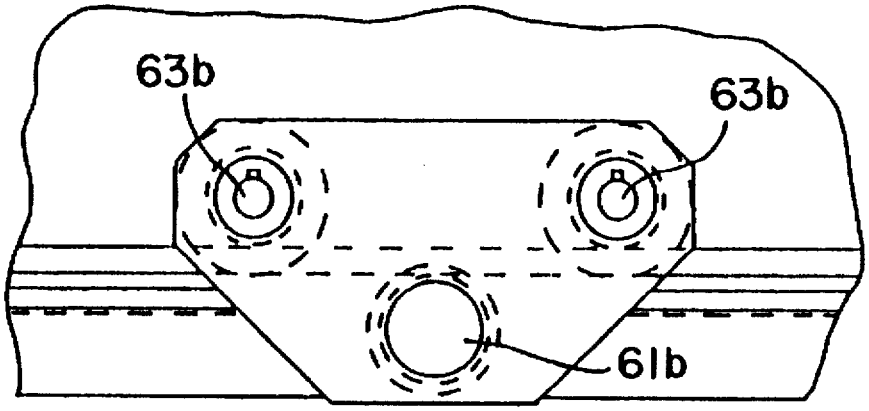
FIG. 9 is a fragmentary vertical sectional view of the tube transporter of FIG. 7, taken along the line 9—9 of FIG. 8.

FIG. 7 shows a cross section of main pressure vessel 2 at a point through which supplemental tube 55 extends. A supplemental tube transporter assembly 60 is shown. Supplemental tube transporter assembly 60 includes a first extendable arm **61*a* and a second extendable arm 61*b*. At one end of each extendable arm is a coupling 63*a,b* respectively, for coupling each extendable arm to a respective pair of wheels 65*a,b*. As shown in FIG. 8, wheels 65*a,b* engage and move along respective tracks 67*a,b*, which extend parallel to one another and longitudinally along the inner surface of main pressure vessel 2. Such a transporter tube assembly 60 could also be disposed in extension pressure chamber 33. The supplemental tube transporter assembly 60 also includes flanges 69*a,b* respectively coupled to the ends of extendable arms 61*a,b* opposite the ends attached to the wheels. Flanges 69*a,b* are selectively attached to supplemental tube 55**.

In operation, transporter tube assembly 60 is used to transport supplemental tube 55 from the exit end of extension pressure chamber 3 to a point so that it engages with a gun tube 24. This is done by first rolling wheels **65*a,b* along tracks 67*a,b* towards the exit end of the pressure vessel. Then, supplemental tube 55 is pushed through the exit hole of the extension pressure vessel 3 and into extension pressure chamber 33. Extendable arms 61*a,b* are extended so that flanges 69A,B are in engagement with supplemental tube 55. Then, the entire assembly 60** is moved towards the entry end of the pressure vessel.

After placing the supplemental tube in engagement with the gun tube and securing the transition section over the top of the gun tube, the gun is ready for firing. Initially, valve 18 is closed when the gun is fired. As a consequence of firing, combustion gases fill main pressure chamber 32 and extension pressure chamber 33. The pressure waves caused by the firing of the gun are attenuated by orifice plate 7 and the baffle and orifice plate assemblies disposed in series in extension pressure chamber 33. Thus, both pressure vessels serve to contain residual combustion gases and attenuate the pressure waves.

Immediately after firing and attenuation of the pressure waves, valve 18 is opened thereby permitting exhaust blower 17 to remove the residual combustion gases from the main pressure chamber. This process is repeated rapidly. As mentioned above, main pressure vessel 2 and extension pressure vessel 3 are preferably covered with sand, which is contained by left-end plate 40 and right-end plate 41.

Figure 10:
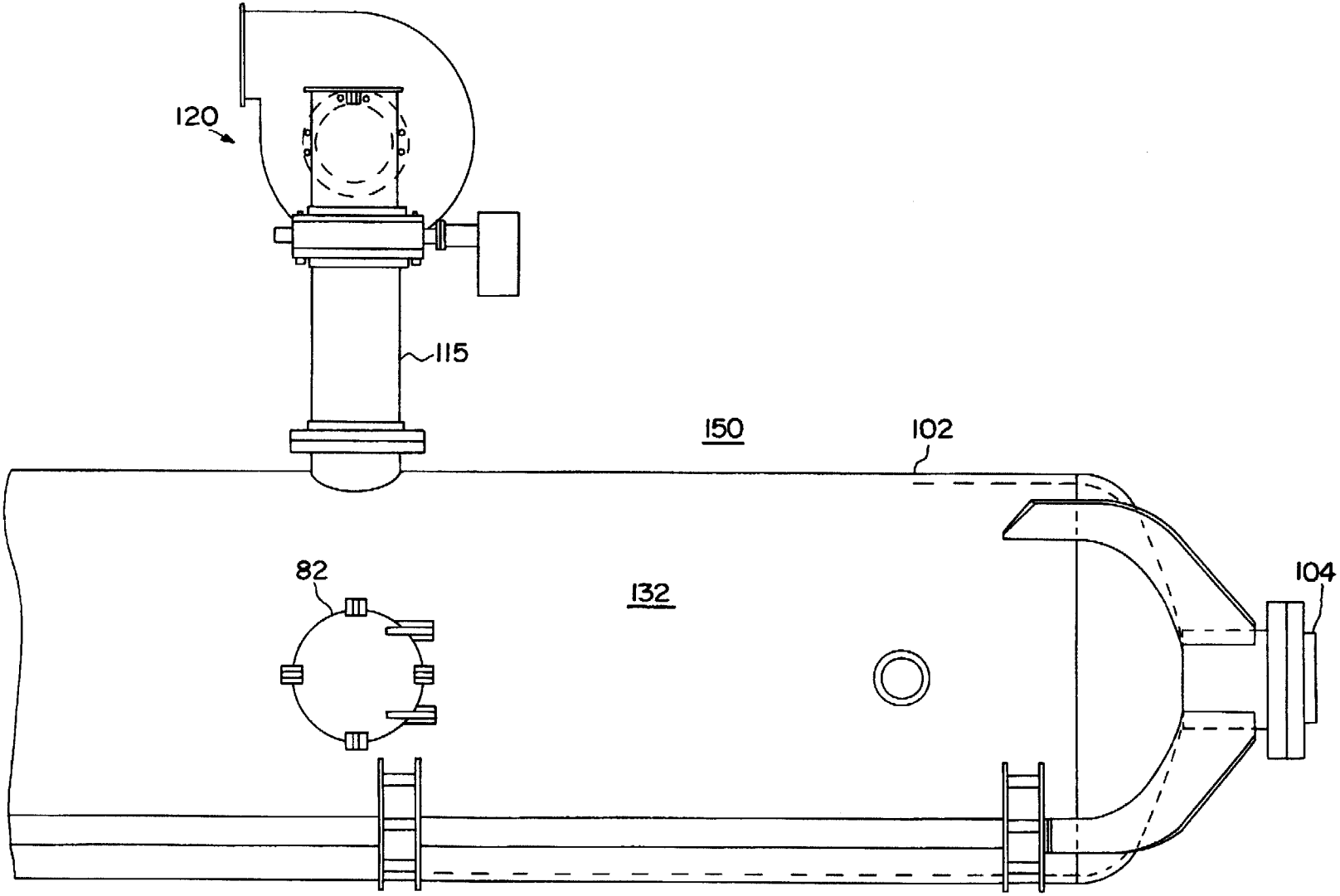
FIG. 10 is a fragmentary longitudinal side elevational view of the right portion of a second embodiment of a gun muffler used with the present invention.
Figure 10A:
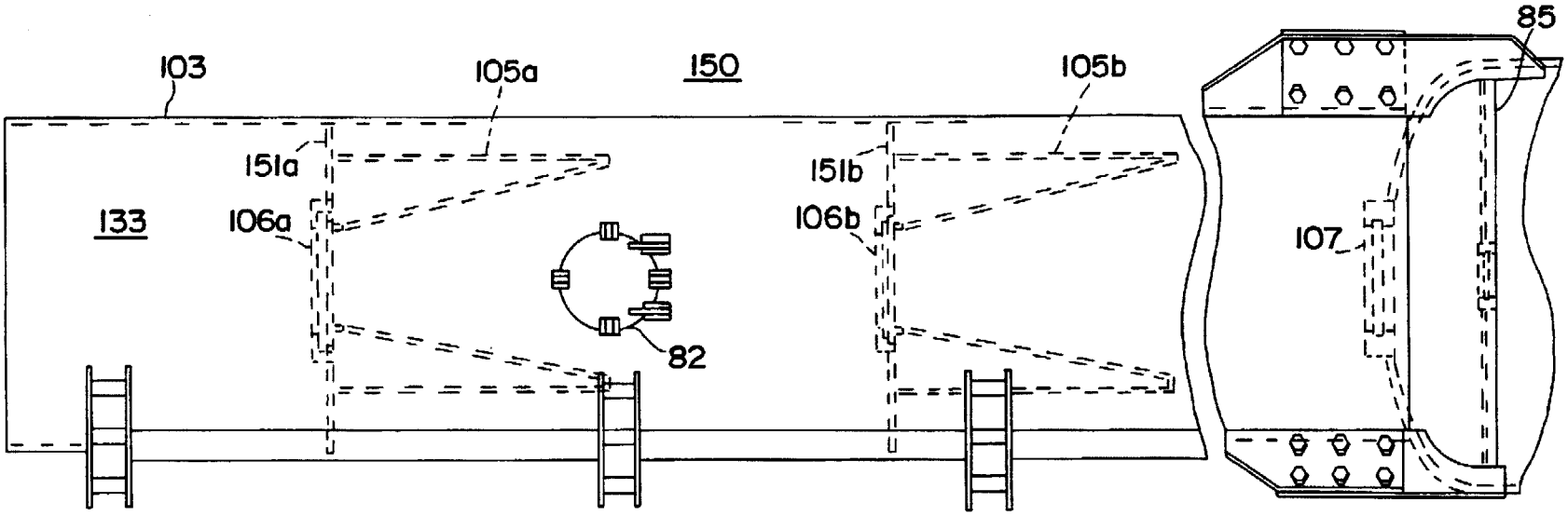
FIG. 10A is a fragmentary longitudinal side elevational view of the left portion of the gun muffler shown in FIG. 10.

A gun muffler 150 in accordance with a second embodiment of the present invention is shown in FIGS. 10 and 10A.

In the same manner as the gun muffler of the first embodiment, gun muffler 150 includes a transition section 104 and at least one pressure vessel. Preferably, gun muffler 150 includes a main pressure vessel 102 defining a main pressure chamber 132 and an extension pressure vessel 103, disposed in series with and connected to main pressure vessel 102 and defining an extension pressure chamber 133. The volume and shape of the pressure vessels may be similar to the first embodiment. Also similar to the first embodiment, gun muffler 150 includes a vent stack 115 and an exhaust blower and valve assembly 120 connected to vent stack 115. As in the first embodiment, the valve of an exhaust blower and valve assembly 120, which preferably is a butterfly valve, closes during firings of the gun for preventing pressure waves caused by firing from escaping directly to the atmosphere during firing and opens between firings for permitting said exhaust blower to remove residual combustion gases from said pressure chamber.

The second embodiment of the invention may also incorporate some other features from the first embodiment. For example, the gun muffler of the second embodiment may include a tube transporter system shown in FIGS. 7–9.

Gun muffler 150 includes at least one orifice plate, which is adjustable relative to the pressure vessels and disposed in a pressure chamber, for attenuating pressure waves. More specifically, FIG. 10A shows three adjustable orifice plates. A first orifice plate 106*a* is disposed in extension chamber 133 and has a first orifice, through which the projectile passes and which is adjustable relative to the longitudinal axis of extension pressure vessel 103. A second orifice plate 106*b* is disposed in series with first orifice plate 106*a* in extension pressure chamber 133 and has a second orifice, through which the projectile passes and which is adjustable relative to the longitudinal axis of extension pressure vessel 103. First orifice plate 106*a* and second orifice plate 106*b* are identical. A third orifice plate 107 is disposed within extension pressure chamber 133 near the connection of main pressure vessel 102 to extension pressure vessel 103 and has a third orifice, through which the projectile passes and which is adjustable relative to the longitudinal axis of extension pressure vessel 103.

Figure 11:
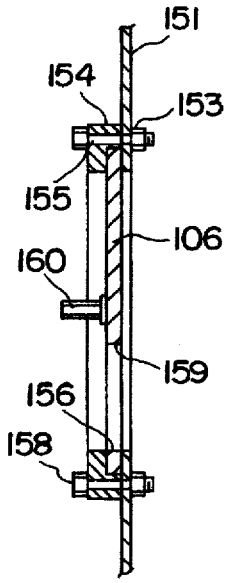
FIG. 11 is an enlarged fragmentary sectional view of the first and second orifice plates shown in FIG. 10A.

The orifice plates may be made adjustable in any known manner. FIG. 11 shows one way to take first and second orifice plates 106*a*, 106*b* adjustable. FIG. 11 shows either orifice plate and the surrounding elements and is discussed below with direct reference to first orifice plate 106*a* and parenthetical reference to second orifice plate 106*b*. A first (or second) mounting plate 151 is connected (i.e., welded or bolted) to extension pressure vessel 103 and has a first (or third) bolt hole 153. As shown in FIG. 10A, energy-absorbing baffles 105*a*, 105*b* may be respectively mounted to first and second mounting plates 151*a*, 151*b*. A first (or second) retaining ring 154 has a second (or fourth) bolt hole 155 aligned with first (or third) bolt hole 153 and has a first (or second) recess 156 confined by first (or second) mounting plate 151. First (or second) orifice plate 106 is secured to first (or second) mounting plate 151 and first (or second) retaining ring 154 at first (or second) recess 156.

A first (or second) bolt 158 extends through first bolt hole 153 and second bolt hole 155 (or through third and fourth bolt holes). By loosening first (or third) bolt 158, first (or second) orifice plate 106 may be adjusted to alter the location of first (or second) orifice 159 relative to the longitudinal axis of extension pressure vessel 103. For example, first (or second) orifice plate 106 may be rotated by rotating first (or second) handle 160, which is connected to first (or second) orifice plate 106. More than one handle may be used to rotate orifice plate 106 for ease of rotation. Upon reaching a desired position of first (or second) orifice, first (or third) bolt 158 is tightened to prevent further rotation of first (or second) orifice plate 106.

Figure 12:
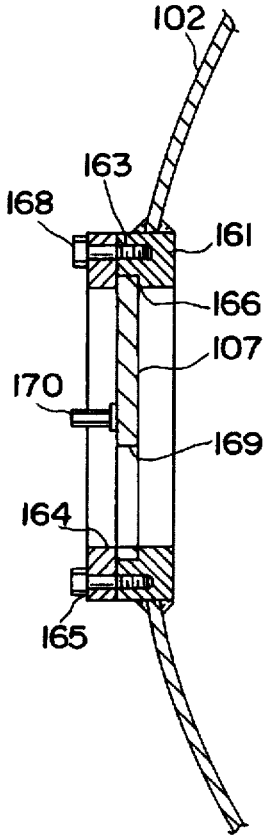
FIG. 12 is an enlarged fragmentary sectional view of the third orifice plate shown in FIG. 10A.

Similarly, as shown in FIG. 12, a third mounting plate 161 is connected (i.e., welded or bolted) to main pressure vessel 102 and has a third recess 166 and a fifth bolt hole 163. A third retaining ring 164 has a sixth bolt hole 165 aligned with fifth bolt hole 163 and confines third recess 166. Third orifice plate 107 is secured to third mounting plate 161 and third retaining ring 164 at third recess 166. A third bolt 168 extends through fifth bolt hole 163 and sixth bolt hole 165. By loosening third bolt 168, third orifice plate 102 may be adjusted to alter the location of third orifice 169 relative to the longitudinal axis of extension pressure vessel 103. For example, third orifice plate 107 may be rotated by rotating third handle 170, which is connected to third orifice plate 107. More than one handle may be used to rotate orifice plate 107 for ease of rotation. Upon reaching a desired position of third orifice, third bolt 168 is tightened to prevent further rotation of third orifice plate 107.

Figure 13:
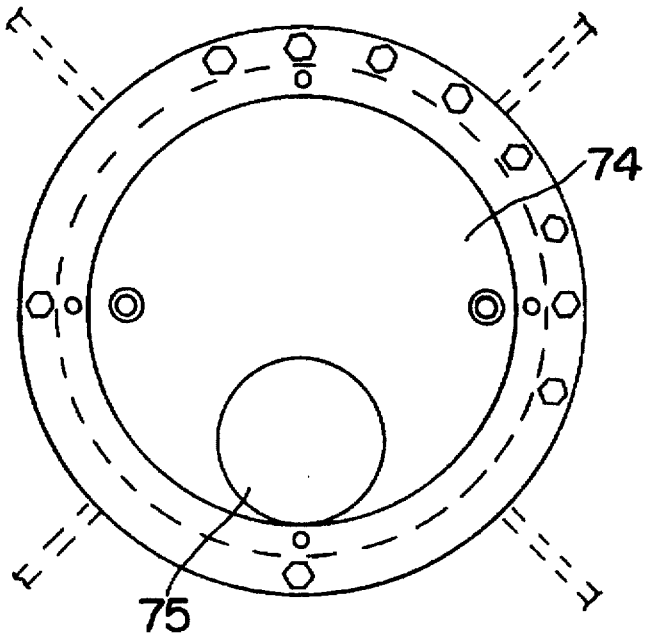
FIG. 13 is a plan view of an orifice plate having a circular, off-centered orifice.

A first type of orifice plate is shown in FIG. 13. The orifice plate 174 as shown has an orifice 175 which is circular and disposed off-centered relative to the orifice plate. Also shown in FIG. 13 is a retainer ring. An alternative type of orifice plate is shown in FIG. 14. There, the orifice plate 178 as shown has an orifice 179 which is elliptical. The orifice plates are adjustable in order to accommodate varying trajectories. Also, orifice plate 178 having an elliptical orifice 179 is particularly useful if a projectile undergoes a drop in trajectory as it travels along the gun muffler.

As shown in FIG. 10A, a plurality of side ports 182 may be disposed along the sides of the pressure vessel. Side ports 182 may be used for a variety of purposes. For example, side ports 182 may be used for access, viewing, photography and radar. Side ports 182 may be made of a transparent material if used for viewing. According to this second embodiment of the invention, gun muffler 150 is not covered with sand in operation.

As shown in FIG. 10A, a sabot catcher 185 is disposed within one of the pressure vessels or entrapping particulates caused by the firing of a gun. Catcher 185 may be made of any suitable material for permitting gas to pass through but for preventing the passage of particulates. For example, it is known to use cables woven together as a sabot catcher. Catcher 185 is mounted to main pressure vessel 102, such as by being welded or bolted thereto. Catcher 185 is preferably disposed in main pressure chamber 132 near the connection of main pressure vessel 102 to extension pressure vessel 103.

Although illustrated and described herein with reference to certain specific embodiments, the claims of the present invention are nevertheless not intended to be limited to the details illustrated and described. Rather, the claims are meant to cover various common modifications without departing from the spirit of the invention.

What is claimed is:

1. A noise abatement system for a large caliber gun having a gun tube, said system comprising:

a horizontal concrete slab;

a gun muffler, mounted on said concrete slab and having an end adapted to be coupled to the gun tube, for attenuating pressure waves caused by a firing of a projectile by the gun;

a projectile stop, mounted on said concrete slab and longitudinally aligned with said gun muffler, for selectively stopping the projectile fired by the gun and for selectively permitting the projectile to pass.

2. A noise abatement system according to claim 1, wherein said projectile stop has an opened first end closest to said gun muffler and a second end to which a door is mounted, wherein said door is closed to stop the projectile fired by the gun and is opened to permit the projectile to pass through said projectile stop.

3. A noise abatement system according to claim 2, wherein said projectile stop is comprised of steel and is substantially rectangular.

4. A noise abatement system according to claim 2, wherein said projectile stop is filled with a particulate material when said projectile stop is used to stop the projectile fired by the gun.

5. A noise abatement system according to claim 4, wherein said particulate material is sand.

6. A noise abatement system according to claim 1, wherein said projectile stop is spaced from said gun muffler.

7. A noise abatement system according to claim 1, wherein said concrete slab is mounted to the ground.

8. A noise abatement system according to claim 1 further comprising a plurality of support piles for mounting said concrete slab to the ground.

9. A noise abatement system according to claim 1 further comprising an arch disposed over said gun muffler.

10. A noise abatement system according to claim 1, wherein said projectile stop is comprised of steel plates having a thickness of about four inches.

11. A noise abatement system according to claim 1, wherein said concrete slab has a thickness of about four feet.

12. A noise abatement system according to claim 1, wherein said projectile stop is sufficiently large to absorb over 1,000,000 foot-pounds of energy.

13. A noise abatement system for a large caliber gun having a gun tube, said system comprising:

a horizontal concrete slab mounted to the ground;

a gun muffler, mounted on said concrete slab and having an end adapted to be coupled to the gun tube, for attenuating pressure waves caused by a firing of a projectile by the gun;

a steel, substantially rectangular projectile stop, mounted on said concrete slab and longitudinally aligned with said gun muffler, for selectively stopping the projectile fired by the gun and for selectively permitting the projectile to pass, said projectile stop:

(a) having two side steel walls parallel with the longitudinal axis of said projectile stop;

(b) a top steel plate bolted to said two side steel walls;

(c) an opened first end closest to said gun muffler; and (d) a second end to which a door is mounted.

* * * * *